US006868892B2

(12) United States Patent
Kimbrough et al.

(10) Patent No.: US 6,868,892 B2
(45) Date of Patent: Mar. 22, 2005

(54) CERAMIC FIBER CORE FOR CASTING

(75) Inventors: Larry C. Kimbrough, Indianapolis, IN (US); Keith R. Gardner, Indianapolis, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 77 days.

(21) Appl. No.: 10/315,720

(22) Filed: Dec. 10, 2002

(65) Prior Publication Data

US 2003/0075301 A1 Apr. 24, 2003

Related U.S. Application Data

(63) Continuation of application No. 09/676,219, filed on Sep. 29, 2000, now abandoned.
(60) Provisional application No. 60/157,393, filed on Oct. 1, 1999.

(51) Int. Cl.[7] ..... B22C 9/10
(52) U.S. Cl. ..... 164/7.1; 164/411; 164/369
(58) Field of Search ..... 164/369, 370, 164/411, 7.1, 160.1; 264/603–683

(56) References Cited

U.S. PATENT DOCUMENTS

| | | | | | |
|---|---|---|---|---|---|
| 2,652,609 | A | * | 9/1953 | Sudia, Jr. | 164/7.1 |
| 3,314,117 | A | * | 4/1967 | Fischman et al. | 164/7.1 |
| 3,596,314 | A | * | 8/1971 | Krugler | 425/388 |
| 3,651,855 | A | * | 3/1972 | Daussan | 164/7.1 |
| 4,228,826 | A | | 10/1980 | Campbell, Jr. | |
| 4,352,390 | A | * | 10/1982 | Larson | 164/351 |
| 4,476,916 | A | | 10/1984 | Nusbaum | |
| 4,968,467 | A | * | 11/1990 | Zievers | 264/621 |
| 4,968,469 | A | | 11/1990 | White | |
| 5,035,593 | A | | 7/1991 | Huang et al. | |
| 5,119,881 | A | * | 6/1992 | Cagle | 164/137 |
| 5,465,780 | A | * | 11/1995 | Muntner et al. | 164/516 |
| 5,500,029 | A | | 3/1996 | Zievers et al. | |
| 5,569,343 | A | | 10/1996 | Garrigus | |
| 5,624,613 | A | * | 4/1997 | Rorabaugh et al. | 264/44 |
| 5,945,049 | A | * | 8/1999 | Vandermeer | 264/87 |
| 6,083,447 | A | * | 7/2000 | Turner | 264/401 |
| 6,365,092 | B1 | * | 4/2002 | Backa et al. | 264/628 |

FOREIGN PATENT DOCUMENTS

JP 04075748 A * 3/1992

* cited by examiner

*Primary Examiner*—Kiley S. Stoner
*Assistant Examiner*—Kevin McHenry
(74) *Attorney, Agent, or Firm*—Susan L. Lukasik; Dennis Kelly Sullivan; Jeffrey P. Calfa

(57) ABSTRACT

There is provided a ceramic fiber casting core used in making cast metal parts comprised of a ceramic fiber structure. The casting core may further comprise a support tube in structural supporting relation to the ceramic fiber structure. There is also provided a method to manufacture the ceramic fiber casting core that comprises mixing ceramic fibers and a binder in a mix tank. Pouring the resultant mixed slurry into a vacuum forming tank. Inserting a perforated mandrel into the vacuum forming tank. Forming a vacuum inside the mandrel resulting in vacuum depositing of the ceramic fiber on the mandrel. Removing the ceramic fiber casting core and mandrel from the vacuum forming tank. Removing the mandrel, and then drying and curing the ceramic fiber structure. When necessary, locating a support member in structural supporting relation to the ceramic fiber structure. Machining the unfinished casting core to a desired outside dimensions.

20 Claims, 5 Drawing Sheets

CERAMIC FIBER CORE FOR CASTING

CROSS-REFERENCE TO RELATED APPLICATIONS

This application is a continuation of Nonprovisional application Ser. No 09/676,219, having a filing date of Sep. 29, 2000, now abandoned which Nonprovisional application claims the benefit of priority of Provisional Application Ser. No. 60/157,393, having a filing date of Oct. 1, 1999.

FIELD OF THE INVENTION

This invention relates generally to casting apparatus and methods for internal combustion engines. More particularly, this invention relates to ceramic fiber casting cores for molding cast iron engine parts.

BACKGROUND OF THE INVENTION

Presently engine manufacturers use a well known sand casting process to solidify iron into engine parts, e.g. engine blocks, cylinder heads, valve covers, etc. In sand casting, a cavity is formed in foundry sand using a pattern of the engine part. The sand is mixed with a binder to retain its shape. Molten iron is poured into the cavity. The sand holds the iron until it solidifies into the shape of the engine part.

The pattern typically has separate upper and lower portions. The upper and lower pattern portions fit together to form the outside shape of the engine part. The upper portion is positioned in an upper half of a flask—an open-ended metal box. The sand and binder mixture is poured into the upper half and compacted around the upper portion, thus taking its shape. Similarly, the lower portion of the pattern is positioned in the lower half of the flask. The sand and binder is poured into the lower half and compacted around the lower portion, thus taking its shape.

The upper and lower portions of the pattern are removed from the sand. The binder holds the sand in place, thus leaving the imprint of the pattern in the sand. In the upper half, holes are cut through sand for pouring iron into the cavity and for air to escape. The flask is assembled to form the mold of the engine part.

Molten iron is poured into a pour hole to fill the cavity in the sand created by the pattern. After the iron solidifies, the flask is disassembled. The engine part and sand are separated. If needed, the engine part is machined or ground to final dimensions and shape.

In the typical sand casting of engine parts, it is often desired and sometimes necessary to have a hollow portion in the engine part. Hollow portions reduce the cost of manufacturing and sometimes are needed for proper operation of the engine. For example, hollow portions must be formed in the engine block for the pistons to operate. The hollow portions, or cylinders, may be formed when the engine block is cast or they may be drilled or machined at a later time. Forming the cylinders when the engine block is cast will generally reduce manufacturing costs compared to machining the cylinders at a later time.

To form a hollow portion during casting, a core or casting core is positioned inside the cavity in the sand. The core will have the desired size and shape of the hollow portion. The core may rest upon sand in the flask. The flask is assembled to form the mold. Molten iron is poured into the mold. The iron solidifies around the core leaving the desired hollow portion.

After the iron solidifies, the flask is disassembled. The engine part and sand are separated including any sand and other core residue in the hollow portion. After the sand is removed, the hollow portion may need machining and grinding to remove imperfections formed during casting.

The "cores" or casting cores are typically made from sand and binder mixtures in core boxes. A core box forms a cavity, having the size and shape of the hollow portion desired. The sand and binder mixture is blown into the core box cavity through a hole in the core box. The core box has other holes to let air escape. The binder is a type that, once cured, causes the sand to maintain a "solid" shape or form of the cavity in the core box. After curing, the core may be removed and positioned inside the mold for an engine part. Core boxes generally have two or more parts, which separate to remove the core.

While necessary to produce the core, the core boxes increase the manufacturing costs of engine parts. For example, in engines using hydraulically actuated fuel injectors, the engine must supply high pressure oil to the fuel injectors for proper operation. While tubes and hoses may be used to supply the oil, a high-pressure oil rail is commonly cast into the cylinder head of the engine. The high-pressure oil rail is an elongated, narrow cavity running the length of the fuel injectors in the engine head.

A core or casting core is typically used to cast a high-pressure oil rail, or cavity, in the cylinder head. For example, as described in U.S. Pat. Nos. 5,119,881; 5,197,532; and 5,333,581, which are incorporated herein. Generally, the core is comprised of an inner and outer portion. The inner portion is used to add structural support to the outer portion of the core. The structural support is necessitated by the oil rail's length. The core's inner supporting portion typically is a steel tube. The core's outer portion is typically made from a sand and binder mixture. To form the core, the steel tube is positioned inside a split-mold core box. The sand and binder mixture is poured around the steel tube, taking the shape of the core box. The sand and binder mixture cures around the steel tube. The core box is separated to remove the finished core.

The existing core-making process described typically results in imperfections. A typical sand core, made with this process, has voids on its surface because of the spacing between the sand grains. In addition, the core box forms parting lines where parts of the core box meet. The parting lines also form voids and/or projections on the core. These voids and projections on the sand core are undesirable. During casting of the engine parts, the voids result in iron penetration into the core. Iron penetration results in parting line fins, veins, and other imperfections on the surface of the high-pressure oil rail. Also, the projections on the sand core create voids on the surface of the high-pressure-rail in this case.

In high-pressure oil rails, these imperfections must be removed to avoid interference with the hydraulic flow. The imperfections also must be removed to keep pieces from breaking off and entering the fuel injectors during engine operation. To remove imperfections, the oil rail must be ground or machined. Other engine parts experience similar requirements when sand cores are used. This grinding and machining increases the manufacturing costs of engine parts.

Moreover, the nature of a sand and binder mixture does not permit the removal of the parting lines or voids between the sand grains. Any attempt to grind or machine the core surface will result in the removal of too much material and a misshaped core. Worse yet, if too much pressure or force is used, the core will break or crumble. In practice, a refractory coating (core wash) is applied to the surface of the sand core. However, the refractory coating does not completely eliminate the inter-granular penetration of molten iron and may result in core wash related defects.

Accordingly, in the manufacture of engine parts from cast iron, there is a need to have a core without parting line voids, without inter-granular voids, and without core wash related defects.

SUMMARY OF THE INVENTION

The present invention provides an apparatus and method for a ceramic fiber casting core having no parting lines, no inter-granular voids, and no core wash defects. In one embodiment, the casting core of the present invention is comprised of a ceramic fiber physical structure, e.g., a ceramic fiber shell or sleeve. In another embodiment, the casting core may have a support member or tube for supporting the physical structure, i.e., the ceramic fiber shell or sleeve. The support tube is typically made of steel, but other materials may be used. The ceramic fiber structure or sleeve is a mixture of ceramic fibers and binder. No core wash is needed. Sealing plugs may be used to seal the ends of the ceramic fiber casting core, thus preventing molten iron from entering the core during casting.

In accordance with the present invention, there is provided a method to manufacture a ceramic fiber casting core. In this method ceramic fibers and a binder are mixed in a mix tank. The ceramic fiber and binder mixture results in a mixed slurry that is then poured into a vacuum forming tank. A perforated mandrel is next inserted into the vacuum forming tank. A vacuum is then created inside the perforated mandrel, which forces a vacuum depositing of the ceramic fiber on the perforated mandrel. When a desired thickness of the ceramic fiber casting core is reached, the ceramic fiber casting core is removed from the vacuum-forming tank. The perforated mandrel is then removed and the remaining ceramic fiber structure, i.e., a sleeve or shell, is transported to an oven for drying and curing. At this point, the ceramic fiber structure is an unfinished casting core. Once cured, the ceramic fiber structure or sleeve is machined to the desired outside dimensions. Last, the ceramic fiber casting core is inspected and tested prior to use.

In another embodiment, subsequent to curing and drying, a support member or tube may be located in a supporting relation to the ceramic fiber structure. The support member is intended to provide structural support for the casting core during the casting of the metal part. At this point, the ceramic fiber structure is an unfinished casting core. The ceramic fiber structure with its support member is then machined to the desired outside dimensions. Finally, the ceramic fiber casting core is inspected and tested prior to use.

Those of skill in the art will readily recognize that there are other embodiments of the ceramic fiber casting core. One embodiment, for example, has a larger inside diameter. While this embodiment reduces the amount of ceramic fiber needed, it also increases the size of the plugs for sealing the core. Another embodiment tapers the inside diameter of the support tube to a smaller opening. This embodiment reduces the amount of ceramic fiber needed while decreasing the size of the plug required. In another embodiment (not shown), an intermediate sleeve is positioned between the support member and the ceramic fiber sleeve. Amongst other benefits, the intermediate sleeve assists in removing the core after casting. The intermediate sleeve maybe made from cardboard or other suitable material.

The following drawings and description set forth additional advantages and benefits of the present invention. Other advantages and benefits are obvious from the description and may be learned by practice of the invention.

BRIEF DESCRIPTION OF THE DRAWINGS

The present invention may be better understood when read in connection with the accompanying drawings, of which.

DETAILED DESCRIPTION OF THE INVENTION

Figure 1:
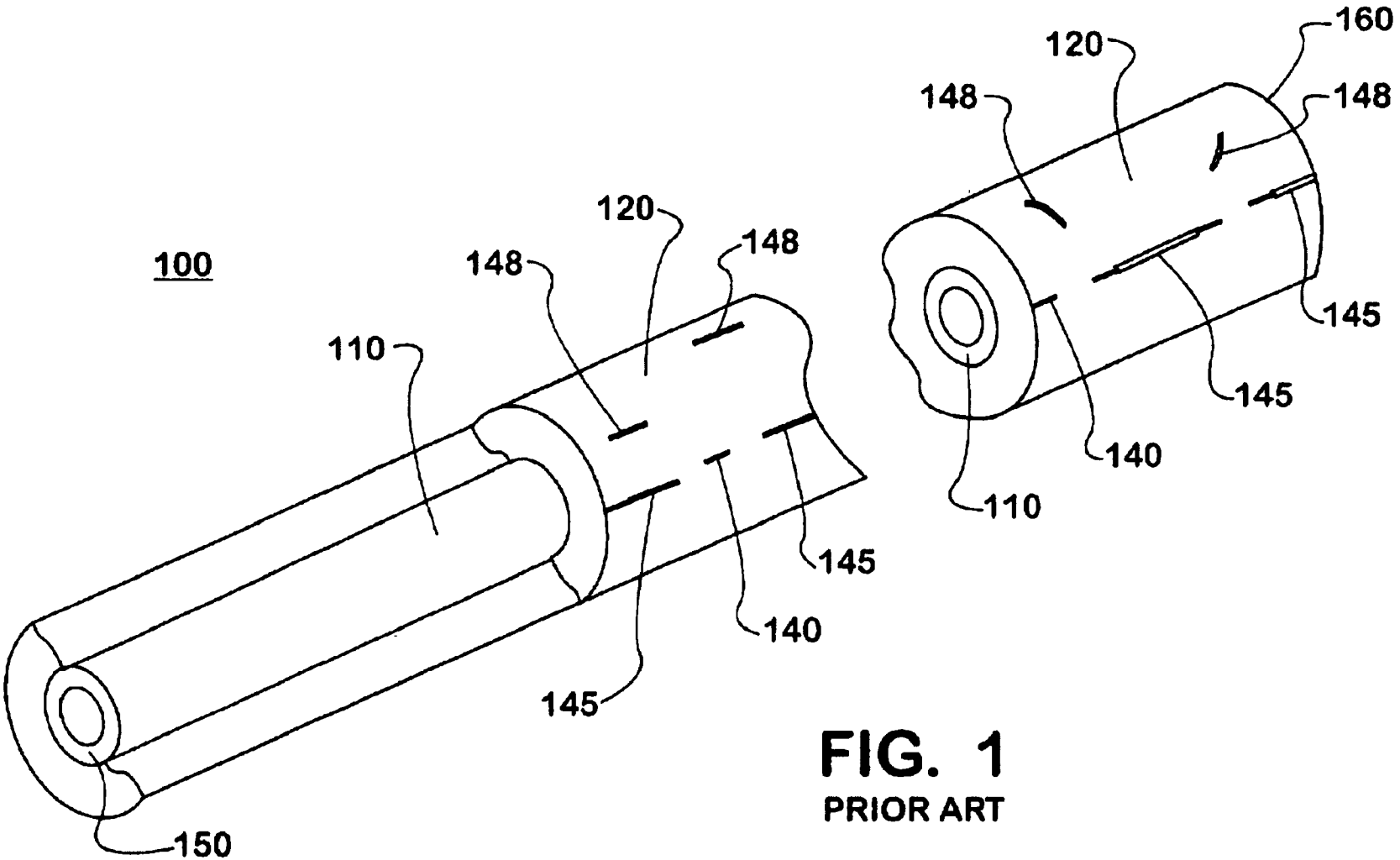
FIG. 1 PRIOR ART
FIG. 1 is a cut-away perspective view of a sand core according to the prior art.

FIG. 1 shows a sand core 100 for a high-pressure oil rail according to the prior art. The sand core 100 has metal tube 110 supporting an outer portion 120 having the shape of the high-pressure oil rail. The outer portion 120 is made from a mixture of foundry sand and a binder. The metal tube 110 has a first end 150 and a second end 160.

In making a typical sand core 100, the metal tube 110 is positioned inside the cavity of a core box (not shown). The cavity has the shape of the high-pressure oil rail. The core box typically has two parts that fit together along a parting line 140 to form the cavity. The sand and binder mixture is then poured into the cavity, surrounding and filling the previously positioned metal tube 110. Once the sand is set, the sand core 100 is removed from the core box for further processing and subsequent drying or curing.

The nature of the sand-binder mixture results in inter-granular spacing (not visible) between the sand grains. The inter-granular-spacing is primarily occupied by the binder material. However, voids 145 and 148 form on the outer surface of the outer portion 120 when the inter-granular spacing becomes large enough and the binder material does not adequately fill the space causing. The two part core box also causes voids 145 to form on the outer surface of the outer portion 120 along the parting line 140. It will be readily appreciated that there are to be more voids 145 and 148 on the unseen rear surface of the outer portion 120 in FIG. 1. If the core box has more parts, voids 145 would form on the additional parting lines 140. In addition, the voids 145 may be located differently if the core box parts fit together differently.

During casting, the voids 145 and 148 cause molten iron to penetrate into the sand core 100. Iron penetration results in parting line fins, veins, and other imperfections on the surface of the high-pressure oil rail. These imperfections in the casting surface must be removed by machining or grinding.

When the sand core 100 is made, the support member or tube is usually filled with the sand and binder material. Alternatively, plugs (not shown) may be inserted into the first end 150 and second end 160 of the metal tube 110. The plugs are usually made from sand, but another refractory or suitable material may be used. Both the sand and binder mixture and the plugs prevent molten iron from entering the metal tube 110 during casting.

Figure 2:
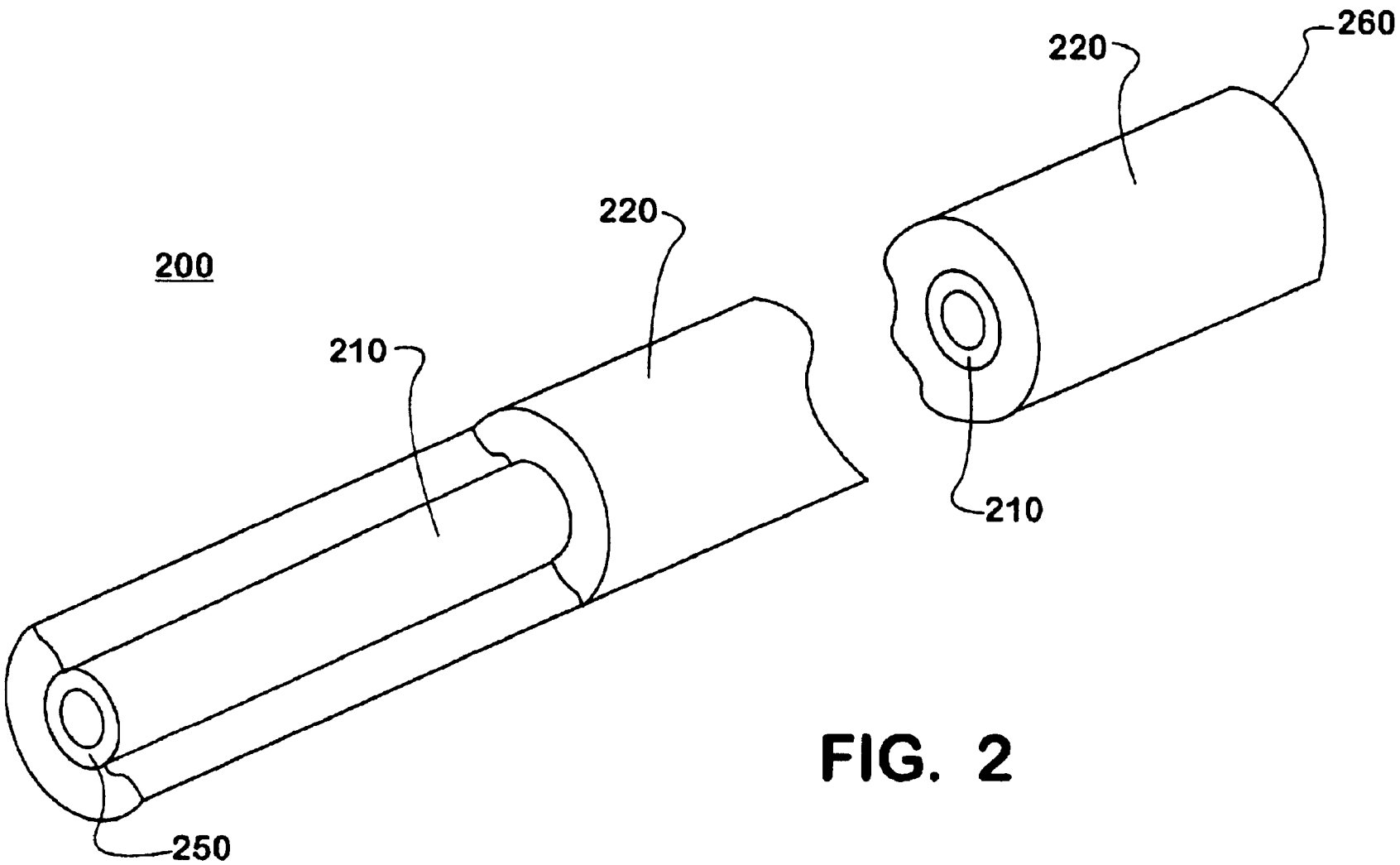
FIG. 2 is a cut-away perspective view of an embodiment of a ceramic fiber casting core according to the present invention.

FIG. 2 shows a preferred embodiment of the ceramic fiber casting core 200 according to the present invention. In this embodiment of the present invention a ceramic fiber casting core is used to make a high-pressure rail cavity or passage in a casted engine block that will accept a hydraulic actuating fluid. The pressures encountered in the high-pressure rail cavity in an engine block are typically in the range of 500–3,500 pounds per square inch (PSI). And, the hydraulic actuating fluid encountered in the high-pressure fluid is preferably used to actuate engine components, e.g., to actuate fuel injectors. Also, in a preferred embodiment, the hydraulic actuating fluid is engine lubricating oil but may be other appropriate fluids. Those of skill in the art will readily appreciate that the ceramic fiber casting core 200 can be configured to any desired shape to fit a particular casting application, not specific to engines.

Further, in this embodiment, the ceramic fiber casting core 200 has a ceramic fiber physical structure or portion 220 and a support member or tube 210 supporting relation to the ceramic structure 220. The support member 210 provides structural support for the ceramic fiber casting core 200 during the casting of a metal part. As mentioned already, certain embodiments of the present invention may have a ceramic fiber structure 220 and no support member 210. The specific parameters and applications requiring a ceramic fiber casting core 200 will determine whether or not a support member 210 is needed.

The casting core 200 shown in FIG. 2 has the shape of the high-pressure oil rail, which has a large length which in turn necessitates a support member 210. The ceramic fiber structure or sleeve 220 is made from a mixture of ceramic fiber and a binder. The support member or tube 210 provides structural support for the ceramic fiber sleeve 220. Further, the support member is preferably a metal tube with a first end 250 and a second end 260. The support member or tube 210 may also be a solid or hollow cylindrical bar, and may be made from plastic, ceramic, steel or any other material able to withstand the temperatures and stresses of iron casting.

In addition, in another embodiment of the present invention, there may be an intermediate sleeve (not shown) between the support member 210 and the outer ceramic fiber portion 220. The intermediate sleeve would enable or improve the connection of the support tube 210 to the ceramic fiber portion or sleeve 220. The intermediate sleeve would also assist in removing the ceramic fiber casting core 200 after casting. The intermediate sleeve may also be any material suitable for these purposes including paper or cardboard, ceramics, and composites.

Figure 3:
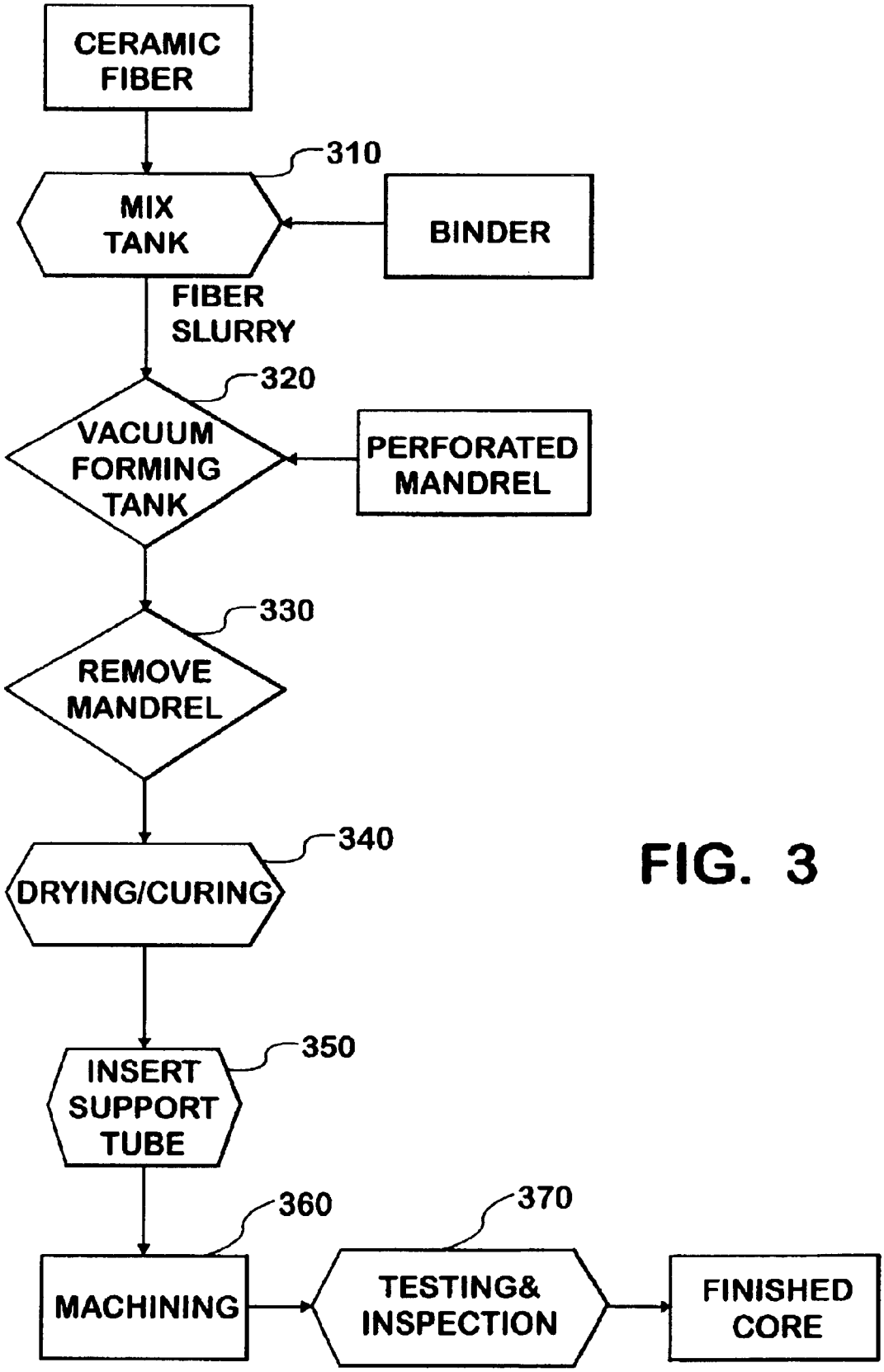
FIG. 3 is a flowchart of a method for manufacturing an embodiment of the ceramic fiber casting cores of the present invention.

FIG. 3 is a flowchart showing a preferred method for manufacturing the ceramic fiber casting core 200 according to the present invention. In step 310, ceramic fiber and binder are mixed in a mixing medium, e.g., a mixing tank, to form a ceramic fiber slurry. The ceramic fiber may be any ceramic fiber suitable for casting processes and for core making. In a preferred embodiment, the ceramic fiber is preferably an alumino-silicate ($Al_2O_3.SiO_2$) fiber. Further, the binder should be suitable for use with the ceramic fiber and is typically organic.

In step 320, the ceramic fiber slurry is placed or poured into a vacuum forming tank. A perforated mandrel is then placed into the ceramic fiber slurry. A vacuum is created inside the perforated mandrel, causing the ceramic fiber slurry to deposit on the outside surface of the mandrel and form a ceramic fiber structure, portion or sleeve around the perforated mandrel. The time in the vacuum forming tank will determine the amount of ceramic fiber material deposited on the perforated mandrel through vacuum depositing. When sufficient ceramic fiber material is vacuum deposited, the perforated mandrel is removed from the vacuum forming tank.

In step 330, the ceramic fiber structure or sleeve 220 is removed from the perforated mandrel. In a preferred embodiment, the ceramic fiber structure, portion or sleeve can slide off the mandrel. The ceramic fiber portion or sleeve 220 is then conveyed to an oven for drying or curing. The perforated mandrel can then be returned to the vacuum forming tank to form another ceramic fiber sleeve 220, as described in step 320.

In step 340, the ceramic fiber sleeve 220 is dried or cured in a convection or radio frequency (RF) oven. Other ovens may be used if they are suitable for the drying or curing process. If a convection oven is used, the ceramic fiber sleeve 220 is hung on a rack for transporting it through the oven. The rack permits air to flow around the ceramic fiber sleeve 220. If an RF oven is used, the ceramic fiber sleeve 220 is transported through the oven by either a conveyor belt or a rack.

In step 350, the ceramic fiber structure or sleeve 220 is removed from the oven. In this embodiment, a support member or tube 210 is then located in supporting relation to the ceramic fiber structure or sleeve 220 to form an unfinished ceramic fiber casting core (not shown). The support member 210 provides structural support for the ceramic fiber structure 220 during the casting of a metal part. The ceramic fiber casting core is unfinished because the exterior of the ceramic fiber sleeve 220 is "fluffy" as a result of the drying or curing process. This "fluffy" exterior must be machined or ground to a desired size.

As mentioned previously, some casting applications may only require an embodiment of the ceramic fiber casting core 200 with a ceramic fiber structure 220 and no support member 210. Those of skill in the art will readily recognize that a determination of whether or not a support member 210 is required will depend on the specific parameters and dimensions of the metal part being cast.

In step 360, the unfinished ceramic fiber casting core is machined or ground to remove the "fluffy" exterior and give the casting core the desired predetermined physical structure or configuration and proper dimensions for the engine part. For a high-pressure oil rail, machining the ceramic fiber casting core will produce a long cylindrical shaped casting core with a smooth surface. For other engine parts, machining permits the exterior of the ceramic fiber casting core to be configured to various dimensions, and structures or shapes. The machining and grinding gives the ceramic fiber casting core a smooth surfaces and precise dimensions. A casting core with smooth surfaces and more precise dimensions provides an as-cast part with smooth surfaces and precise dimensions, virtually eliminating the need to further machine or grind this area of the casting.

In step 370, the ceramic fiber casting core 200 is tested and inspected. The testing and inspection includes measuring the surface hardness, checking its dimensions, determining its loss on ignition, and assessing other factors that may affect its performance. If the ceramic fiber casting core 200 "passes" the inspection and tests, it is ready for use. A ceramic fiber casting core 200 made in this manner will not have the parting line 140 and voids 145 and 148 associated with existing sand cores 100 (shown in FIG. 1). Consequently, the ceramic fiber casting core 200 does not need core wash or another refractory coating.

Although not shown, the ceramic fiber casting core 200 may undergo post treatment after testing and inspection. The post treatment may be to correct some "failure" identified during testing and inspection. The inspection may reveal the diameter of the ceramic fiber casting core 200 is not to the desired tolerance. In addition, the post treatment may also improve the ceramic fiber casting core 200. For example, the ceramic fiber casting core 200 may be impregnated with another material to enhance and improve its casting capabilities.

Prior to placing the ceramic fiber casting core in a mold part, plugs (not shown) may be inserted into the first and second ends 250 and 260 of the support tube 210. The plugs are made of cork or other suitable material. The plugs prevent molten iron from entering the support tube 210 during casting. Using plugs can eliminate sand from the coremaking process.

FIGS. 4–11 show cross-sectional side and full end views of alternate embodiments or applications using the ceramic fiber casting core 200 of the present invention to produce a high-pressure oil rail in an engine. The ceramic fiber casting cores are shown in their as-cast position inside the casting. The ceramic fiber casting cores and oil rails are symmetrical in these views. However, those of skill in the art will recognize that the ceramic fiber casting core 200 may take different structures or configurations, even asymmetrical, to produce other engine parts. For comparison purposes, the oil rails depicted in FIGS. 4–11 all have essentially the same length.

FIGS. 4–11 further show various embodiments of the ceramic fiber casting core 200 with varying physical end structures and inside oil rail diameter. These features provide advantages for the present invention. In high-pressure oil rails, sealing plugs are typically mounted in the ends of the oil passage. Presently, the ends of the oil rail are machined to receive the sealing plugs. While the inside diameter of the oil rail remains sufficient to maintain the volume and pressure of the oil for the injectors.

Figure 4:
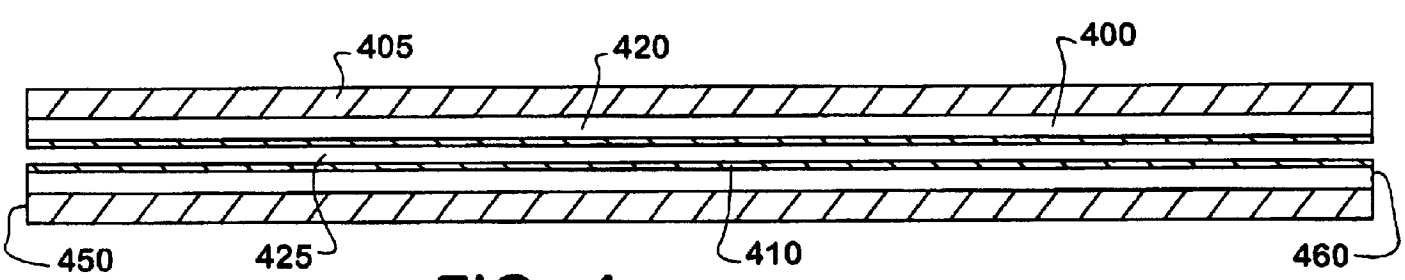
FIG. 4 is a cross-sectional side view of the ceramic fiber casting core in an as-cast position inside a casting according to a first embodiment of the present invention.
Figure 5:
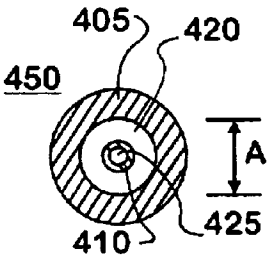
FIG. 5 is a full end view of the ceramic fiber casting core and the casting shown in FIG. 4.

FIG. 4 shows a side-section view of a ceramic fiber casting core 400 in its as-cast position inside the oil rail casting 405. This embodiment has the same physical structure as a typical sand core. The ceramic fiber casting core 400 is comprised of a support tube 410 inside a ceramic fiber sleeve 420. The ceramic fiber casting core 400 forms an oil rail passage 425 having diameter A (shown in FIG. 5). The ceramic fiber casting core 400 and oil rail casting 405 have a first end 450 and a second end 460. FIG. 5 shows a first end 450 that corresponds to a full end view of the ceramic fiber casting core 400 of FIG. 4.

Figure 6:
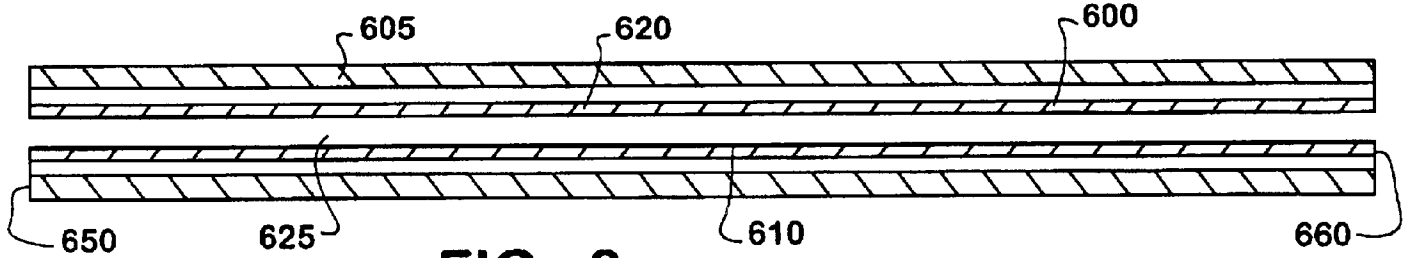
FIG. 6 is a cross-sectional side view of the ceramic fiber casting core in an as-cast position inside a casting according to a second embodiment of the present invention.
Figure 7:
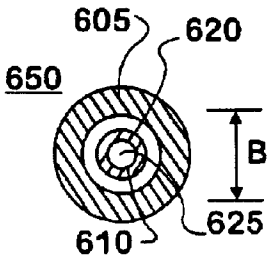
FIG. 7 is an end view of the ceramic fiber casting core and the casting wall shown in FIG. 6.

FIG. 6 shows a side-section view of a ceramic fiber casting core 600 in its as-cast position inside the oil rail casting 605. This embodiment is also the same as a typical sand core. The ceramic fiber casting core 600 again is comprised of a support tube 610 inside a ceramic fiber sleeve 620. However, the ceramic fiber casting core 600 forms an oil rail passage 625 having diameter B (shown in FIG. 7). The ceramic fiber casting core 600 and oil rail casting 605 have a first end 650 and a second end 660. FIG. 7 shows the first end 650 that corresponds to a full end view of the ceramic fiber casting core 600 of FIG. 6.

Comparing the embodiments of FIGS. 4 and 6, oil rail passage 625 (diameter B) is larger than oil rail passage 425 (diameter A). Oil rail casting 405 has sufficient thickness for machining the sealing surfaces (not shown) at ends 450, 460. However, oil rail casting 405 also has excess material, the unmachined portion in its center, which increases the engine's weight and size. In contrast, oil rail casting 605 is sized according to the oil rail passage which minimizes its size and weight. A possible downside of this embodiment is that oil rail casting 605 permits no internal machining since there is insufficient material for machining the sealing surfaces. Thus, the ceramic fiber casting cores embodiments of FIGS. 4 and 6 possess different features and advantages.

Figure 8:
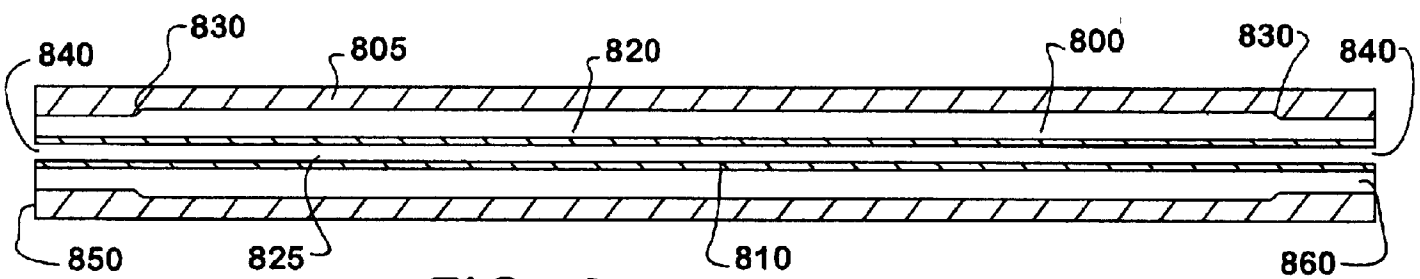
FIG. 8 is a cross-sectional side view of the ceramic fiber casting core in an as-cast position inside a casting, according to a third embodiment of the present invention.
Figure 9:
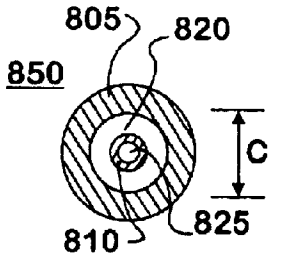
FIG. 9 is an end view of the ceramic fiber casting core and the casting shown in FIG. 8.

FIG. 8 shows a side-section view of a ceramic fiber casting core 800 in its as-cast position inside the oil rail casting 805. The ceramic fiber casting core 800 in this embodiment has an advantageous physical structure that would be difficult, if not impossible, to duplicate in a typical sand core within dimensional tolerances suitable for casting operations. The ceramic fiber casting core 800 is comprised of a support tube 810 inside a ceramic fiber sleeve 820. The ceramic fiber casting core 800 forms an oil rail passage 825 having diameter C (shown in FIG. 9). The ceramic fiber casting core 800 and oil rail casting 805 have a first end 850 and a second end 860. Moreover, in this embodiment, the ceramic fiber casting core 800 forms a taper 830 at each end 850 and 860. The taper 830 forms a taper opening 840 at each end 850 and 860. The diameter of the taper opening 840 is smaller than the diameter C of the oil rail passage 825. FIG. 9 shows the first end 850, which corresponds to a full end view of the ceramic fiber casting core 800 of FIG. 8.

Figure 10:
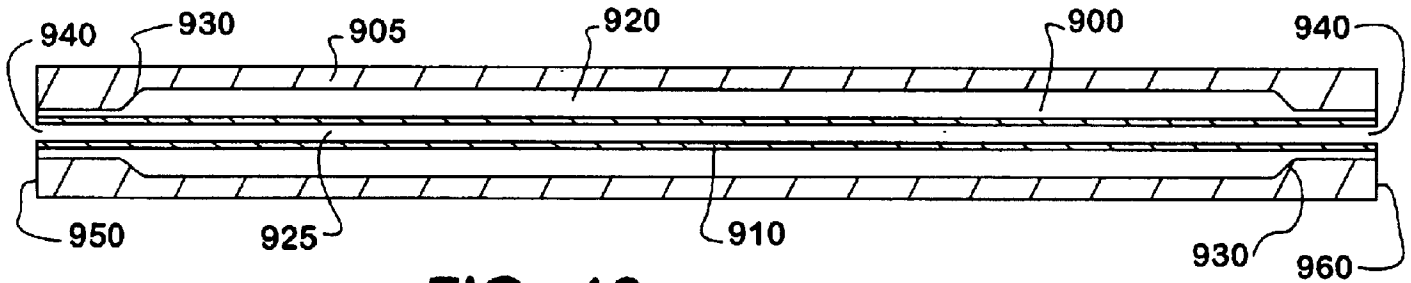
FIG. 10 is a cross-sectional side view of the ceramic fiber casting core in an as-cast position inside a casting according to a fourth embodiment of the present invention.
Figure 11:
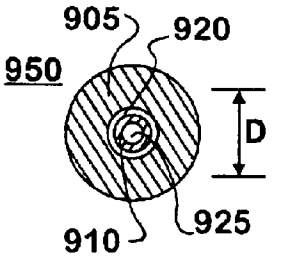
FIG. 11 is an end view of the ceramic fiber casting core and the casting shown in FIG. 10.

FIG. 10 shows a side section view of a ceramic fiber casting core 900 in its as-cast position inside the oil rail casting 905. Again, the ceramic fiber casting core 900 in this embodiment also has an advantageous physical structure that would be difficult to duplicate in a typical sand core within dimensional tolerances suitable for casting operations. The ceramic fiber casting core 900 is comprised of a support tube 910 inside a ceramic fiber sleeve 920. The ceramic fiber casting core 900 forms an oil rail passage 925 having diameter D (shown in FIG. 11). In this embodiment, diameter D may be the same as diameter C. The ceramic fiber casting core 900 and oil rail casting 905 have a first end 950 and a second end 960. The ceramic fiber casting core 900 forms a taper 930 at each end 950 and 960. The taper 930 forms a taper opening 940 at each end 950 and 960. The diameter of the taper opening 940 is smaller than Diameter D of the oil rail passage 925. Moreover, the taper opening 940 is smaller than the taper opening 840 of the embodiment shown in FIG. 8. FIG. 11 shows the first end 950, which corresponds to a full end view of the ceramic fiber casting core 900 of FIG. 10.

Taper openings 830 and 930 provide additional finish stock for the machining of the sealing surfaces at the ends

850, 860, 950 and 960 of the oil rail castings 805 and 905. The taper openings 830 and 930 reduce the size and weight of the oil rail castings 805 and 905. In addition, taper opening 930 provides more finish stock on oil rail casting 905 than taper opening 830 provides for oil rail casting 805. As a result, opening 940 is smaller than opening 840. A smaller threaded plug may thus be used to seal oil rail casting 905 compared to the seal plug for oil rail casting 805. This feature results in greater cost reduction to manufacturing an engine part-using the embodiment of FIG. 10.

The invention has been described in relation to a ceramic fiber casting core, and method for such core, for use in making a high-pressure rail cavity or passage in an internal combustion engine that accepts hydraulic actuating fluid. However, those of skill in the art will readily recognize that the invention may be used to provide ceramic fiber casting cores in casting other metal parts, including, but not limited to, engine parts. The present invention is particularly suited for applications using casting cores of variable dimensions and shapes which may or may not required the use of a support member. This is the case since the ceramic fiber casting core of the present invention is capable of being configured, machined and ground to any desired surface shape and dimensions.

Thus, the present invention has been described and illustrated by way of certain preferred embodiments only. The invention may also be used to manufacture or cast engine parts, other than the high-pressure oil rail specifically discussed herein. Additional advantages will be readily apparent to those skilled in the art, who may modify the embodiments without departing from the true spirit and scope of the invention. Therefore, this invention is not limited to the specific details, representative devices, and illustrated examples in this description. The present invention is limited only by the following claims and equivalents.

We claim:

1. A method of casting a metal part, wherein the method comprises the steps of:

placing a perforated mandrel having an outside surface in a slurry comprised at least in part of ceramic fiber;

creating a vacuum inside the perforated mandrel, thereby causing the slurry to deposit as a sleeve on the outside surface of the perforated mandrel;

drying the sleeve;

configuring an outside surface of the sleeve, yielding a ceramic core;

casting a metal part around at least the ceramic core.

2. The method of claim 1, wherein the step of configuring comprises the step of machining the outside surface of the sleeve to at least one of a desired shape, dimensions, and texture.

3. The method of claim 1, wherein the step of configuring comprises the step of grinding the outside surface of the sleeve to at least one of a desired shape, dimensions, and texture.

4. The method of claim 1, wherein the step of configuring comprises the step of configuring the outside surface of the sleeve to a smooth surface.

5. The method of claim 1, wherein the step of configuring comprises the step of configuring the outside surface of the sleeve to a smooth surface without parting lines and without inter-granular voids.

6. The method of claim 1, wherein the step of configuring comprises the step of at least one of machining and grinding to render the outside surface of the sleeve smooth and having precise dimensions such that a casting made utilizing the sleeve does not require machining and grinding where the outside surface of the sleeve was utilized in the casting.

7. The method of claim 1, further comprising the step of removing the sleeve from the perforated mandrel prior to the drying step.

8. The method of claim 1, further comprising the step of curing the sleeve prior to the configuring step.

9. The method of claim 1, wherein the ceramic fiber comprises an alumino-silicate material.

10. The method of claim 1, wherein the slurry further comprises a binder.

11. The method of claim 1, further comprising the step of forming a taper in at least one end of the ceramic core.

12. The method of claim 1, further comprising the step of impregnating the ceramic core with another material.

13. The method of claim 1, further comprising the step of inserting a support member inside the sleeve prior to the casting step.

14. A method of casting a metal part, wherein the method comprises the steps of:

placing a perforated mandrel having an outside surface in a slurry comprised at least in part of ceramic fiber;

creating a vacuum inside the perforated mandrel, thereby causing the slurry to deposit as a sleeve on the outside surface of the perforated mandrel;

removing the perforated mandrel with deposited slurry from the slurry;

drying the sleeve;

inserting a support member inside the sleeve;

configuring an outside surface of the sleeve, yielding a ceramic core;

casting a metal part around at least the ceramic core.

15. The method of claim 14, wherein the method eliminates parting lines, inter-granular voids, and core wash defects from the ceramic core.

16. The method of claim 14, wherein the step of configuring comprises the step of configuring the outside surface of the sleeve to a smooth surface.

17. The method of claim 14, wherein the step of configuring comprises the step of configuring the outside surface of the sleeve to a smooth surface without parting lines and without inter-granular voids.

18. The method of claim 14, wherein the step of configuring comprises the step of at least one of machining and grinding to render the outside surface of the sleeve smooth and having precise dimensions such that a casting made utilizing the sleeve does not require machining and grinding where the outside surface of the sleeve was utilized in the casting.

19. The method of claim 14, further comprising the step of forming a taper in at least one end of the ceramic core.

20. The method of claim 14, further comprising the step of removing the sleeve from the perforated mandrel prior to the drying step.

* * * * *